United States Patent [19]

Hur

[11] 4,374,190

[45] Feb. 15, 1983

[54] ERASABLE INTERMEDIATE DIAZO-TYPE PAPER

[75] Inventor: John Y. Hur, Poughkeepsie, N.Y.

[73] Assignee: AM International, Inc., Chicago, Ill.

[21] Appl. No.: 265,742

[22] Filed: May 21, 1981

Related U.S. Application Data

[63] Continuation of Ser. No. 946,896, Sep. 28, 1978, abandoned.

[51] Int. Cl.[3] ..... G03C 1/80

[52] U.S. Cl. ..... 430/19; 428/411; 428/425.1; 428/512; 428/513; 428/913; 430/160; 430/169

[58] Field of Search ..... 430/19, 169, 160; 428/425.1, 411, 913, 513, 512; 96/75

[56] References Cited

U.S. PATENT DOCUMENTS

| | | | |
|---|---|---|---|
| 2,861,008 | 11/1958 | Hollmann | 430/19 |
| 3,627,563 | 12/1971 | Bollen | 430/19 |
| 3,728,123 | 4/1973 | Gipe | 430/19 |
| 3,733,200 | 5/1973 | Takaishi | 430/19 |
| 3,756,823 | 9/1973 | Haaf | 430/19 |
| 3,779,775 | 12/1973 | Chiba | 430/19 |
| 3,912,512 | 10/1975 | Kumins | 430/19 |
| 3,923,518 | 12/1975 | Muller | 428/520 |
| 4,058,399 | 11/1977 | McNeil | 430/19 |

FOREIGN PATENT DOCUMENTS

| | | | |
|---|---|---|---|
| 51-108826 | 9/1976 | Japan | 430/160 |
| 1268666 | 3/1972 | United Kingdom | 430/160 |

*Primary Examiner*—Ellis P. Robinson

[57] ABSTRACT

A non-crinkling, wrinkling or curling erasable diazo-type intermediate material comprising a flexible light transmitting substrate, a flexible barrier layer on the substrate comprising an aliphatic organic alcohol insoluble elastomeric or thermoplastic material coated on the substrate in a non-aqueous medium and dried, and a photosensitive layer overlaying the barrier layer comprising an aliphatic alcohol soluble polymer resin binder, a diazo dye and an azo coupler, the photosensitive composition being dissolved in a non-aqueous solvent, coated and dried.

2 Claims, No Drawings

ERASABLE INTERMEDIATE DIAZO-TYPE PAPER

This is a continuation of application Ser. No. 946,896 filed Sept. 28, 1978 now abandoned.

BACKGROUND OF THE INVENTION

This invention relates to erasable intermediate diazo-type paper. More specifically, it is concerned with a non-crinkling non-curling diazo-type erasable paper which has excellent image development and easy erasability using any of the conventional erasing means without leaving an image ghost. The invention contemplates the formation of light sensitive paper by first coating a light transmitting substrate material with a non-aqueous solution of an elastomeric barrier layer material followed by coating the barrier layer with a non-aqueous solution of a diazo containing composition to form a light sensitive diazo-type erasable paper.

For engineers, architects, designers and draftsmen, diazo-type intermediates perform two essential duties, as second originals and as base elements for revision of old, or composition of new drawings. When revising drawings and composing new drawings, all repetitive elements of the drawings are diazo-typed and only new information is drawn. This constructive usage requires a superior base paper with a superior drawing surface. Marring the surface, such as made by correction fluids, is to be avoided. The erasable diazo-type intermediates have enabled drawings to be erased by simple erasing thus providing the drafting professions with a valuable tool. The diazo-type papers allow erasure by the interposition of one or more interlayers, or barrier layers, between the base paper, film or cloth and the diazo or sensitizing layer. Any suitable interlayer must of necessity combine good hold-out against penetration or migration of the diazo compounds while possessing a strong affinity for the barrier layer. Qualities sought in an erasable diazo intermediate paper are good pencil and ink receptivity, visual transparency, manual and mechanical erasability with little or no ghosting of the erased imprints, glossing or deterioration of the surface with good transparency to ultra-violet light permitting rapid diazo reproduction and no crinkling and curling.

It is known in the art to prepare erasable diazo-type paper, for example, by first coating transparentized paper with an aqueous solution of a polymeric material to form a barrier layer which is then overcoated with an aqueous solution of a diazo-type sensitizing solution. Material for accomplishing such intermediate paper is disclosed, for example, in U.S. Pat. No. 4,058,399, other prior art references disclosing the background, material and processes for preparing erasable paper are U.S. Pat. Nos. 2,423,768; 2,646,363; 2,861,008; 3,418,469; 3,624,021; 3,627,563 and 3,813,261. Unfortunately, erasable transparentized papers in general have a tendency to cause "ghosts", for example, when folded, erased or scratched. "Ghosts" are caused by fracture of the substances used to prepare the paper. Ghost lines resulting from fractures block light, causing undesirable lines to be formed in copies on other paper. Moreover, there has been the tendency of the known erasable diazo-type intermediate paper to more quickly yellow with any prolonged exposure to ultraviolet light. The known formulations for preparing diazo-type erasable paper also exhibit a tendency to cause crinkling, curling and/or wrinkling during one or more stages of manufacture and in the finished product resulting in numerous disadvantages in the use of such papers. It will be appreciated in the art that while the known diazo-type erasable papers have made a valuable contribution to the art, for the most part, the heretofore known erasable papers lack one or more of the qualities most desirable in an erasable intermediate type paper.

SUMMARY OF THE INVENTION

In accordance with this invention there are provided simple and practical formulations which enable the manufacture of a photosensitive erasable diazo-type paper in two steps which offers all of the qualities sought in such papers. The erasable paper prepared using the formulation of the invention has good pencil and ink receptivity; is easily erasable with conventional erasing means, and after erasing, readily accepts pencil or ink in the erased areas, is substantially non-scratchable by ordinary drawing instruments, does not "ghost" after erasure, is dimensionally stable and does not curl or crinkle during and after manufacture.

Various other objects, benefits and advantages of the invention will become readily apparent from the detailed description hereafter.

It was discovered that a non-crinkling, non-curling photosensitive diazo-type erasable paper providing images of sharp contrast, in addition to providing other qualities desired in such paper may be prepared by first coating a transparent substrate with a non-aqueous solution of an aliphatic alcohol solvent insoluble rubbery coating, followed, after drying of the barrier coat, by overlaying with a sensitizer solution comprising a non-aqueous solution of an aliphatic alcohol soluble formulation comprising a diazo-dye, an azo coupler, and an aliphatic hydroxy carboxylic acid.

DESCRIPTION OF THE PREFERRED EMBODIMENTS

In the description of the invention herein, the term "transparentized" paper, or substrate, refers to a flexible light transmitting substrate material, whether naturally transparent, or transparentized by any of the well-known means for treating paper, film or cloth to produce the desired light transmissability.

When preparing photosensitive diazo-type erasable paper, the substrate material must be protected from the penetration of the sensitizing solutions. Penetration of the diazo material into the base is detrimental and to a great extent hampers erasures on the paper. The interposition of a coating of a barrier material between the base and the sensitizing layer is necessary to prevent such penetration. Any barrier material used must, however, allow the transmission of light, be flexible with the substrate, come off relatively easily, with erasure, and have good adhesion to the substrate and sensitizer layer, yet must be completely insoluble in the sensitizing solution. Also quite important, the barrier layer should not permit crinkling or curling of the substrate. The barrier layer formulation of the invention comprises a non-aqueous solution of an aliphatic alcohol insoluble elastomeric or thermoplastic material, including styrenated co- and terpolymers, for example, polyurethane, vinyl toluene-α-methyl styrene copolymer, polystyrenebutadiene copolymers, polystyrene acrylate terpolymer, polybutadiene rubber, polystyrene ethylene butylene block copolymer and pentaerythritol ester of dimeric resin acid and mixtures thereof. While any suitable organic solvents, excluding aliphatic alcohol solvent, may be utilized to place the above resins in solution, the solvents in the preferred embodiment of the barrier layer are toluene, methyl ethyl ketone, methyl cellosolve acetate and mixtures thereof. It is essential that the barrier layer not be soluble in either the sensitizing layer formulation solvent or any ingredient of the sensitizing formulation.

The photosensitive, or sensitizer, layer is applied directly to the dried barrier layer coat. One of the principal advantages of the present invention is that any of the well-known coating techniques may be used for applying the barrier layer and sensitizer layer. Excellent results are obtainable, for example, by the simple and conventional technique of applying the solution with a roller and removing excess solution with a wire wound rod. While it is not critical, the barrier layer is generally applied in a thickness of about 0.1 to 0.5 mil.

The sensitizer layer of the invention comprises a non-aqueous solution of an aliphatic alcohol soluble polymer resin binder, a diazo dye, an azo coupler, an acid, and a dye fixative. It is important to the invention that no water be present in either the barrier layer or sensitizer layer solutions. As a solvent for the sensitizer formulation, the combination of methanol and methyl cellosolve has been found to be quite satisfactory. The ratio of the methanol and methyl cellosolve, is not critical, however, in the preferred embodiments the ratios range from 2:1 to 8:1 respectively. As mentioned hereinbefore, the well-known roller and wire wound rod method may be conveniently used for applying the sensitizing solution and removing the excess.

There are many diazo dyes known in the art which may be successfully used in the formulations of the invention. While 4-diazo-2,5-diethoxyphenyl morpholine zinc chloride has been found to be quite suitable, the zinc chloride salt or hexafluorophosphate of N-4-diazo-2,5-diethoxyphenyl morpholine; p-diazo-N-ethyl-N-hydroxyethyl benzene; 2,5-diethoxy-4-pyrrolidino benzene; 2,5-diethoxy-4-morpholino aniline; 2,5-dimethoxy-4-morpholino aniline; and N,N-diethyl-p-phenylene-diamine, to name a few, give excellent results.

Any suitable coupler may also be used in the sensitizer of the invention, for example, sulfides of resorcinol, phenols, and catechols. An aliphatic hydroxy carboxylic acid such as citric, malic, tartaric and lactic is used in the sensitizer solution to prevent premature coupling. Zinc chloride may also be used as a stabilizer thereby enhancing the shelf-life of the sensitizer formulation. Also generally included in the sensitizer formulation is a diazo dye fixative, for example, thiourea. As known in the art, erasability is improved by the inclusion of silica. In the preferred embodiment of the invention, silica having a particle size in the range of about 1–15 μm is included in the sensitizer layer. The concentrations of the light sensitive diazo compound and the coupling agent used in the sensitizer layer of the invention are present in stoichiometric amounts.

The following examples illustrate the inventive formulations used in the preparation of the erasable diazotype paper of the application. In all of the examples, a transparentized paper substrate was used. In all examples, the surface of the paper substrate was coated with the barrier layer formulation solution. After drying of the barrier layer, the barrier coated substrate was coated with the sensitizer formulation. The barrier layer and sensitizer layer in each of the examples were applied by means of the conventional roller application followed by removal of the excess material by a wire wound rod.

EXAMPLE I

| BARRIER LAYER | |
|---|---|
| Methyl ethyl ketone | 85 cc |
| Methyl cellosolve acetate | 15 cc |
| Polyurethane | 8 gms |
| Vinyl toluene-α-methyl styrene copolymer | 5 gms |

| SENSITIZER LAYER | |
|---|---|
| Methanol | 85 cc |
| Methyl cellosolve | 15 cc |
| ½ second cellulose acetate propionate | 5 gms |
| Citric acid | 1.0 gms |
| Thiourea | 0.2 gms |
| Zinc chloride | 1.0 gms |
| Diresorcinol sulfide-4-diazo-2,5-diethoxyphenyl morpholine zinc chloride | 3.6 gms |
| Silica 4 m | 4.0 gms |

Numerous barrier layers formulations were also successfully prepared for use in the invention comprising quantities of polyurethane ranging from 3–24 gms and vinyl toluene-α-methyl styrene copolymer from 1.85–15 gms.

EXAMPLE II

| BARRIER LAYER | |
|---|---|
| Toluene | 100 cc |
| Polystyrene-butadiene copolymer | 4 gms |
| Polystyrene acrylate terpolymer | 2 gms |
| Vinyl toluene-α-methyl styrene copolymer | 0.5 gms |

| SENSITIZER LAYER | |
|---|---|
| Methanol | 65 cc |
| Methyl cellosolve | 35 cc |
| ½ second cellulose acetate propionate | 5 gms |
| Citric acid | 1.5 gms |
| Thiourea | 1.5 gms |
| Zinc chloride | 1.0 gms |
| Diresorcinol sulfide 4-diazo-2,5-diethoxyphenyl morpholine zinc chloride | 3.5 gms |
| Silica 2 m | 2.8 gms |
| | 7 gms |

The quantities of three elastomers were varied in the preparation of other barrier layers used in the preparation of erasable papers. It was found that an excellent barrier could be obtained when the quantity of polystyrene butadiene copolymer ranged from about 2–20 gms, the quantity of polystyrene acrylate terpolymer from 1–10 gms and the vinyl toluene-α-methyl styrene copolymer from about 0.25–2.5 gms.

EXAMPLE III

| BARRIER LAYER | |
|---|---|
| Toluene | 100 cc |

-continued

| BARRIER LAYER | |
|---|---|
| Polystyrene butadiene rubber | 13 gms |

The sensitizer layer of this Example was prepared utilizing the same formulation as that used in Example II.

EXAMPLE IV

| BARRIER LAYER | |
|---|---|
| Toluene | 100 cc |
| Polystyrene butadiene rubber | 7 gms |
| Pentaerythritol ester of dimeric resin acid | 2 gms |

The sensitizer layer of this Example was prepared utilizing the same formulation as that used in Example II.

EXAMPLE V

| BARRIER LAYER | |
|---|---|
| Toluene | 100 cc |
| Polystyrene butadiene rubber | 5 gms |
| Polystyrene ethylene butadiene rubber | 5 gms |
| Pentaerythritol ester of dimeric resin acid | 1.5 gms |

The sensitizer layer of this Example was prepared utilizing the same formulation as that used in Example II.

The polyurethane used in the barrier layer of the Examples had a melting point of 200 degrees F., glass transition temperature −34 degrees C., MW of about 50,000 and a viscosity range of about 500–800 cps at 25 degrees C., 15% solid in THF. The vinyl toluene-α-methyl styrene was identified by a softening point of 75 degrees C., melting viscosity at 100 degrees C.—100 poise, melting point 100 degrees C. and a specific gravity at 25 degrees C.—1.04. The polystyrene butadiene copolymer used had a Mooney viscosity of 38–46 and a styrene composition of 22.5–24.5%. The polystyrene acrylate terpolymer had the physical properties of a softening point at 155 degrees C. (Ring and Ball), Brookfield viscosity of 33% in xylene, glass transition temperature 61 degrees C. and a critical solution temperature of 16 degrees F., 33% in xylene. The polystyrene butadiene copolymer of the Examples was a radial block copolymer of styrene butadiene with 30% styrene having a specific gravity of 0.92, inherent viscosity of 0.93 and a Brookfield viscosity—20% in toluene, 512 cps. The pentaerythritol ester of dimeric resin acid had a softening point of 185 degrees C.–197 degrees C., acid no. 25 viscosity−X at 25 degrees C., 50% solids in mineral acid, and a specific gravity of 1.09 at 25/25 degrees C.; and the polystyrene ethylene block copolymer had a tensile strength of 6500 PSI, a 500% elongation at break, a styrene/rubber ratio of 30/70 and a solution viscosity of 800 cps, 20% solid in toluene.

Erasable paper prepared using the formulation of the Examples was dimensionally stable and did not curl, crinkle or wrinkle during or after applying either of the barrier or sensitizing layers. Moreover, the erasable diazo-type paper prepared using the formulations of the invention and excellent receptivity for hard and soft pencils and for India ink. Lines imprinted thereon were sharp and easily and clearly erasable with either conventional soft erasers or mechanical erasers. Of great importance is the fact that the paper exhibited sharp receptivity to both pencil and ink print in erased areas. The paper exhibited remarkable stability without any tendency to yellow upon prolonged exposure to light.

It is understood that variations in coating techniques, proportions of ingredients and materials may be made without departing from the spirit and scope of the invention which is defined by the following claims.

I claim:

1. An erasable, light transmitting, non-curling diazo-type intermediate comprising a transparentized paper substrate, a first dry barrier coating on said substrate, said coating being formed from a coating solution consisting of a non-aqueous solution of polyurethane and vinyl toluene-α-methyl styrene copolymer dissolved in a mixture of methyl ethyl ketone and methyl cellosolve acetate, and a second dry light sensitive layer overlying said first barrier layer, said second light sensitive layer being deposited from a non-aqueous aliphatic alcohol soluble sensitizer formulation comprising a diazo composition, said barrier layer being insoluble in said sensitizer formulation, said barrier layer having good adhesion to both said light sensitive layer and said paper.

2. An erasable, light transmitting non-curling diazo-type intermediate comprising a transparentized paper substrate, a first dry barrier coating on said substrate formed from a solution consisting of a non-aqueous solution of polystyrene-butadiene copolymer, polystyrene acrylate terpolymer and vinyl toluene-α-methyl styrene copolymer dissolved in toluene, and a second dry light sensitive layer comprising a diazo composition, said light sensitive layer being coated from a non-aqueous aliphatic alcohol soluble sensitizer formulation comprising a diazo compound, overlying said first barrier coating, said barrier coating being insoluble in said sensitizer formulation, said barrier coating having good adhesion to both said substrate and said overlying light sensitive layer.

* * * * *